US006113455A

United States Patent [19]

Whelan et al.

[11] Patent Number: 6,113,455

[45] Date of Patent: Sep. 5, 2000

[54] VERSATILE CRIB MOUNTED MOBILE

[76] Inventors: Kim Whelan, 2602 E. Denton Ave., Saint Francis, Wis. 53235; Susan Goecks, 21663 W. Bonnie La., Lannon, Wis. 53046

[21] Appl. No.: 09/271,855

[22] Filed: Mar. 18, 1999

[51] Int. Cl.[7] ..... A63H 33/00

[52] U.S. Cl. ..... 446/227; 248/214

[58] Field of Search ..... 446/227; 248/105, 248/106, 107, 214

[56] References Cited

U.S. PATENT DOCUMENTS

| | | | |
|---|---|---|---|
| 2,948,499 | 8/1960 | Manny . | |
| 4,627,588 | 12/1986 | Block . | |
| 4,664,640 | 5/1987 | Shindo et al. . | |
| 4,984,380 | 1/1991 | Anderson . | |
| 5,250,002 | 10/1993 | Kinberg et al. . | |
| 5,387,146 | 2/1995 | Smith et al. | 446/175 |
| 5,478,268 | 12/1995 | Au | 446/227 |
| 5,803,786 | 9/1998 | McCormick | 446/227 |
| 5,912,624 | 9/1999 | Howard, II | 340/632 |
| 5,951,360 | 9/1999 | Fearon et al. | 446/227 |

*Primary Examiner*—Kien T. Nguyen
*Assistant Examiner*—Jeffrey D. Carlson

[57] ABSTRACT

A child play station system is provided including a frame having a cross bar and a pair of legs each being bifurcated into a pair of vertical portions which each terminate in a foot which defines a slot adapted for receiving a rail of a crib. At least one toy is coupled to the frame. In use, the frame is adapted for being supported by the legs on a flat recipient surface.

12 Claims, 3 Drawing Sheets

VERSATILE CRIB MOUNTED MOBILE

BACKGROUND OF THE INVENTION

1. Field of the Invention

The present invention relates to child entertainment systems and more particularly pertains to a new versatile crib mounted mobile for entertaining a child within a stationary crib, a portable crib, or on a floor surface while simultaneously monitoring the child from afar.

2. Description of the Prior Art

The use of child entertainment systems is known in the prior art. More specifically, child entertainment systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,640,034; U.S. Pat. No. 4,363,181; U.S. Pat. No. 3,060,628; U.S. Pat. No. 5,672,088; U.S. Pat. No. 2,723,856; and U.S. Pat. No. Des. 336,495.

In these respects, the versatile crib mounted mobile according to the present invention substantially departs from the conventional concepts and designs of the prior art, and in so doing provides an apparatus primarily developed for the purpose of entertaining a child within a stationary crib, a portable crib, or on a floor surface while simultaneously monitoring the child from afar.

SUMMARY OF THE INVENTION

In view of the foregoing disadvantages inherent in the known types of child entertainment systems now present in the prior art, the present invention provides a new versatile crib mounted mobile construction wherein the same can be utilized for entertaining a child within a stationary crib, a portable crib, or on a floor surface while simultaneously monitoring the child from afar.

The general purpose of the present invention, which will be described subsequently in greater detail, is to provide a new versatile crib mounted mobile apparatus and method which has many of the advantages of the child entertainment systems mentioned heretofore and many novel features that result in a new versatile crib mounted mobile which is not anticipated, rendered obvious, suggested, or even implied by any of the prior art child entertainment systems, either alone or in any combination thereof.

To attain this, the present invention generally comprises a frame having a horizontal cross bar with a square cross-section along a length thereof. As such, the horizontal cross bar has a top face, a bottom face, a pair of side faces, and a pair of ends. Each end is equipped with a pair of spring biased tabs mounted on the top face and the bottom face thereof. The frame further includes a pair of legs each having a hollow short upper horizontal portion with a plurality of apertures formed therein. By this structure, the legs are adapted for slidably receiving one of the ends of the horizontal cross bar. The legs may further be selectively fixed with respect to the horizontal cross bar by the engagement of the spring biased tabs and the apertures. Each of the legs is bifurcated into a pair of diverging vertical portions which reside in a plane which is perpendicular with the horizontal cross bar. As shown in FIG. 3, a horizontal brace is mounted between intermediate extents of the vertical portions of the leg. Ideally, a pair of annular toys are rotatably mounted on such horizontal braces. Each vertical portion of the legs terminates with a foot having a vertically oriented threaded post. This post is threadedly engaged within a threaded aperture formed in the vertical portion, as shown in FIG. 5. Four downwardly extending blocks define a pair of intersecting slots each having a unique width. In use, the feet of the frame serve for being removably mounted on any one of a plurality of cribs having unique widths and rails of unique thickness. Next provided is a light assembly including an opaque elliptical dome mounted on a central extent of the top face of the horizontal cross bar of the frame. As shown in FIGS. 1 & 3, a plurality of cut outs are formed in the dome. A motor is connected between the frame and the dome for rotating the same about a vertical axis upon the actuation of the light assembly. Associated therewith is a light positioned with the dome for emitting light from the cut outs upon the actuation of the light assembly. Mounted within the horizontal cross bar of the frame is a music mechanism which is adapted to emit music upon the actuation thereof. A monitoring unit is also positioned within the horizontal cross bar of the frame and includes a microphone. This microphone is mounted on one of the side faces of the horizontal cross bar of the frame for detecting audible signals upon the receipt thereof. Connected to the microphone is a transmitter for transmitting the audible signals via free space. As shown in FIG. 1, a mobile includes a disk removably attached to a central extent of the bottom face of the horizontal cross bar of the frame. A plurality of flexible resilient arcuate members are coupled to a periphery of the disk and extend outwardly and downwardly therefrom. Each of the arcuate members are equipped with a figurine mounted on an end thereof. A motor is connected between the frame and the disk for rotating the same upon the actuation thereof. Positioned within the horizontal cross bar of the frame is a timer which is adapted to track a predetermined amount of time. Connected to the music mechanism, the light assembly, the mobile and the timer is a control panel situated on one of the side faces of the horizontal cross bar of the frame. Such control panel is equipped with a music button for actuating the music mechanism upon the depression thereof, a light button for actuating the light assembly upon the depression thereof, and a mobile button for actuating the mobile upon the depression thereof. Finally, when depressed, a timer button is adapted for deactuating each of the foregoing features that has been actuated upon the cessation of the predetermined amount of time as indicated by the timer. With reference now to FIG. 2, a portable module includes a speaker for transmitting audible signals therefrom upon the receipt thereof. Connected to the speaker is a receiver for transmitting audible signals thereto upon the receipt thereof via free space from the transmitter of the monitoring unit. As such, a small child may be monitored from afar. It should be noted that the mobile unit also includes a music button, a light button, a mobile button, and a timer button as set froth hereinabove. The control panel is preferably equipped with a receiver in order to allow such remote control of the various features of the frame. As shown in FIG. 6, a plurality of eyelets are mounted along the bottom face of the horizontal cross bar of the frame and a bottom of the horizontal portion of each of the legs. Associated therewith is a plurality of figurines each having a string coupled thereto with a hook for removably attaching to the eyelets of the frame. As such, when the present invention is used on a flat area such a ground surface, the mobile may be replaced with the removable figurines for interactive entertainment purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new versatile crib mounted mobile apparatus and method which has many of the advantages of the child entertainment systems mentioned heretofore and many novel features that result in a new versatile crib mounted mobile which is not anticipated, rendered obvious, suggested, or even implied by any of the prior art child entertainment systems, either alone or in any combination thereof.

It is another object of the present invention to provide a new versatile crib mounted mobile which may be easily and efficiently manufactured and marketed.

It is a further object of the present invention to provide a new versatile crib mounted mobile which is of a durable and reliable construction.

An even further object of the present invention is to provide a new versatile crib mounted mobile which is susceptible of a low cost of manufacture with regard to both materials and labor, and which accordingly is then susceptible of low prices of sale to the consuming public, thereby making such versatile crib mounted mobile economically available to the buying public.

Still yet another object of the present invention is to provide a new versatile crib mounted mobile which provides in the apparatuses and methods of the prior art some of the advantages thereof, while simultaneously overcoming some of the disadvantages normally associated therewith.

Still another object of the present invention is to provide a new versatile crib mounted mobile for entertaining a child within a stationary crib, a portable crib, or on a floor surface while simultaneously monitoring the child from afar.

Even still another object of the present invention is to provide a new versatile crib mounted mobile that includes a frame having a cross bar and a pair of legs each being bifurcated into a pair of vertical portions which each terminate in a foot which defines a slot adapted for receiving a rail of a crib. At least one toy is coupled to the frame. In use, the frame is adapted for being supported by the legs on a flat recipient surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
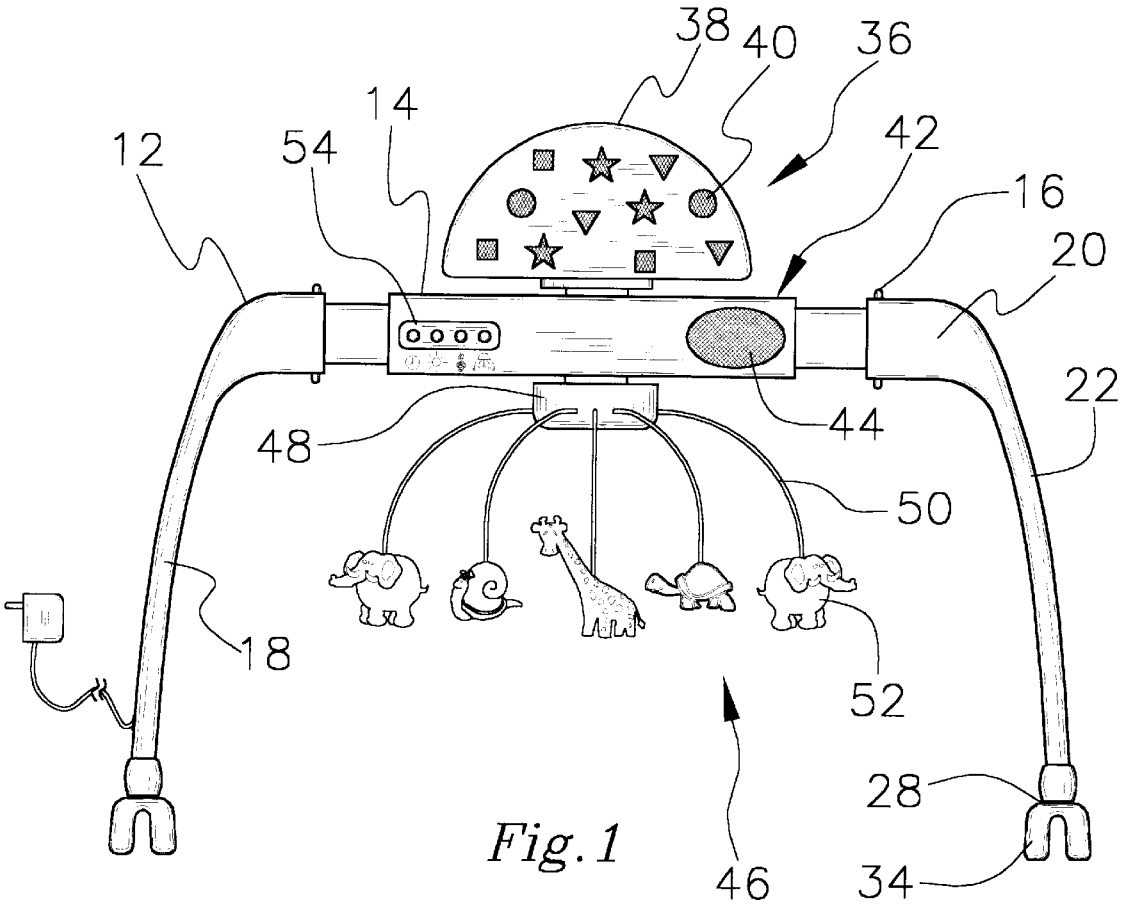
FIG. 1 is a front view of a new versatile crib mounted mobile according to the present invention.

With reference now to the drawings, and in particular to FIGS. 1 through 6 thereof, a new versatile crib mounted mobile embodying the principles and concepts of the present invention and generally designated by the reference numeral 10 will be described.

The present invention, designated as numeral 10, includes a frame 12 having a horizontal cross bar 14 with a square cross-section along a length thereof. As such, the horizontal cross bar has a top face, a bottom face, a pair of side faces, and a pair of ends. Each end has a reduced cross-section and is equipped with a pair of spring biased tabs 16 mounted on the top face and the bottom face thereof.

Figure 3:
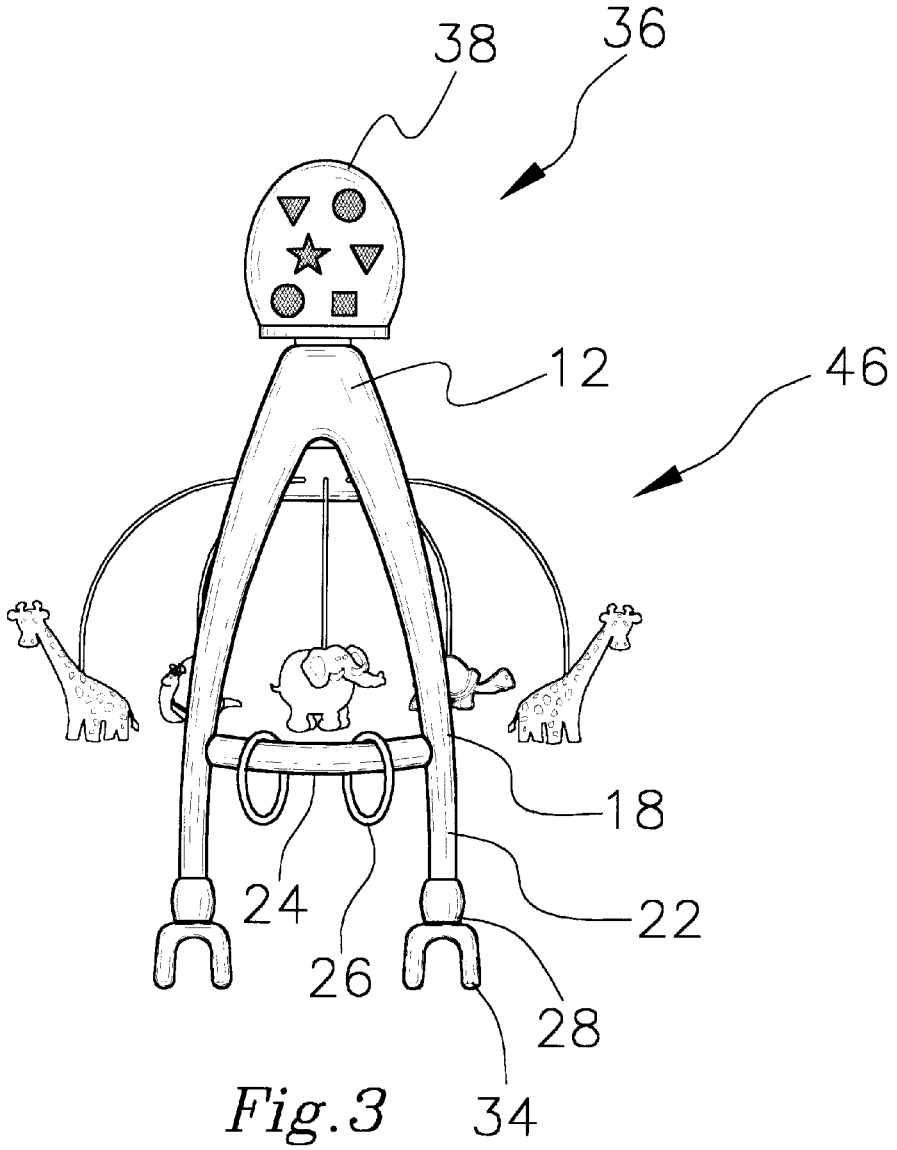
FIG. 3 is a side view of the frame of the present invention.
Figure 4:
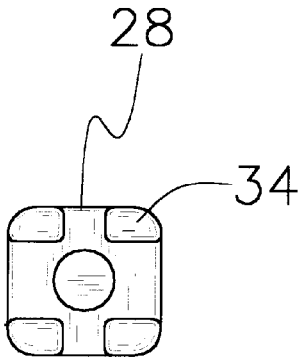
FIG. 4 is a bottom view of one of the feet of the present invention.

The frame further includes a pair of legs 18 each having a hollow short upper horizontal portion 20 with a plurality of apertures formed therein. By this structure, the legs are adapted for slidably receiving one of the ends of the horizontal cross bar. The legs may further be selectively fixed with respect to the horizontal cross bar by the engagement of the spring biased tabs and the apertures. Each of the legs is bifurcated into a pair of diverging vertical portions 22 which reside in a plane which is perpendicular with the horizontal cross bar. As shown in FIG. 3, a horizontal brace 24 is mounted between intermediate extents of the vertical portions of the leg. Ideally, a pair of annular toys 26 are rotatably mounted on such horizontal braces.

Figure 5:
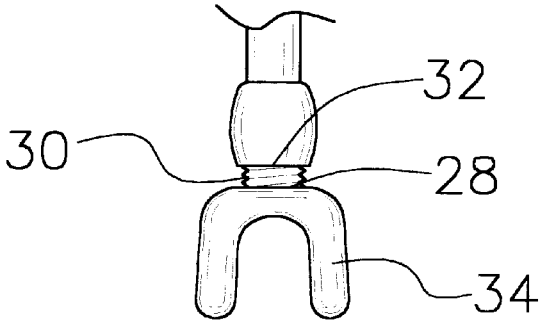
FIG. 5 is a side view of one of the feet of the present invention.

Each vertical portion of the legs terminates with a foot 28 having a vertically oriented threaded post 30. This post is threadedly engaged within a threaded aperture 32 formed in the corresponding vertical portion, as shown in FIG. 5. Four downwardly extending blocks 34 define a pair of intersecting slots each having a unique width. In use, the feet of the frame serve for being removably mounted on any one of a plurality of cribs having unique widths and rails of unique thickness. It should be noted that the feet may merely be rotated to accommodate a rail of a varied thickness. Further, the blocks of the feet preferably have planar bottom surfaces for being supported on a ground surface.

Next provided is a light assembly 36 including an opaque elliptical dome 38 mounted on a central extent of the top face of the horizontal cross bar of the frame. As shown in FIGS. 1 & 3, a plurality of cut outs 40 are formed in the dome. A motor is mounted on the frame and connected to the dome for rotating the same about a vertical axis upon the actuation of the light assembly. Associated therewith is a light positioned with the dome for emitting light from the cut outs upon the actuation of the light assembly. Power may be supplied to the light from a battery or power outlet by annular or brush contacts. Also on the horizontal cross bar of the frame is a music mechanism (not shown) which is adapted to emit soft/quiet music upon the actuation thereof.

A monitoring unit 42 is also positioned within the horizontal cross bar of the frame and includes a microphone 44. This microphone is mounted on one of the side faces of the horizontal cross bar of the frame for detecting audible signals upon the receipt thereof. Connected to the microphone is a transmitter for transmitting the audible signals via free space. A separate actuator switch may be provided for selectively actuating the transmitter.

As shown in FIG. 1, a mobile 46 includes a disk 48 removably attached to a central extent of the bottom face of the horizontal cross bar of the frame. A plurality of flexible resilient arcuate members 50 are coupled to a periphery of the disk and extend outwardly and downwardly therefrom. Each of the arcuate members are equipped with a figurine 52 mounted on an end thereof. An unillustrated motor is mounted on the frame and connected to the disk for rotating the same upon the actuation thereof. As an option, the motor has a rotor with a male couple which is adapted to releasably engage a female couple on the disk, or visa-versa.

Positioned within the horizontal cross bar of the frame is an unillustrated timer which is adapted to track a predetermined amount of time. Connected to the music mechanism, the light assembly, the mobile and the timer is a control panel 54 situated on one of the side faces of the horizontal cross bar of the frame. Such control panel is equipped with a music button for actuating the music mechanism upon the depression thereof, a light button for actuating the light assembly upon the depression thereof, and a mobile button for actuating the mobile upon the depression thereof. Finally, when depressed, a timer button is adapted for deactuating each of the foregoing features that has been actuated upon the cessation of the predetermined amount of time as indicated by the timer. Ideally, such predetermined amount of time may be selected by way of a slider switch for times of 10, 20, & 30 minutes, or continuously. In addition, the timer is digital or the like so as to afford a quiet non-ticking timer. Further, the specific tune may also be selected by any user desired means and preferably includes soft quiet music. It should be understood that powering may be afforded by an alternating power receptacle and/or battery. While not shown, the battery compartment is located in the back face of the horizontal crossbar. The alternating power receptacle is detachable when converting the mobile to a floor toy, or child play station.

Figure 2:
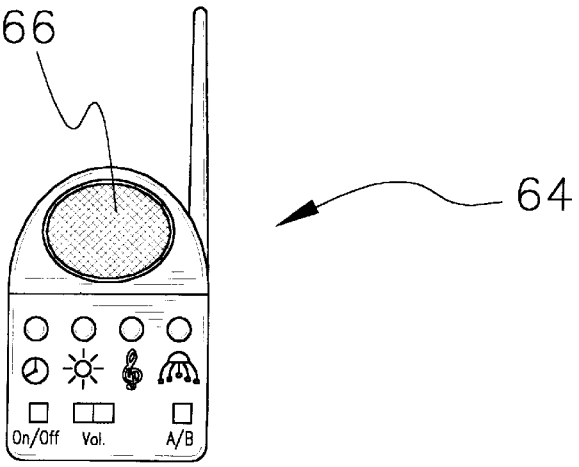
FIG. 2 is a front view of the portable module of the present invention.

With reference now to FIG. 2, a portable module 64 includes a speaker 66 for transmitting audible signals therefrom upon the receipt thereof. Associated with the speaker is a volume selector for selectively determining the volume of the audible signals. Connected to the speaker is a receiver for transmitting audible signals thereto upon the receipt thereof via free space from the transmitter of the monitoring unit. As such, a small child may be monitored from afar. Similar to the transmitter of the monitoring unit, the receiver of the portable module is preferably selectively actuated by way of a dedicated switch. It should be noted that the portable module also includes a music button, a light button, a mobile button, and a timer button similar to those set froth hereinabove. Further, a power button and a radio channel/band selector may be included, as shown in FIG. 2. The control panel is preferably equipped with a receiver in order to allow remote control of the various features of the frame by these buttons.

Figure 6:
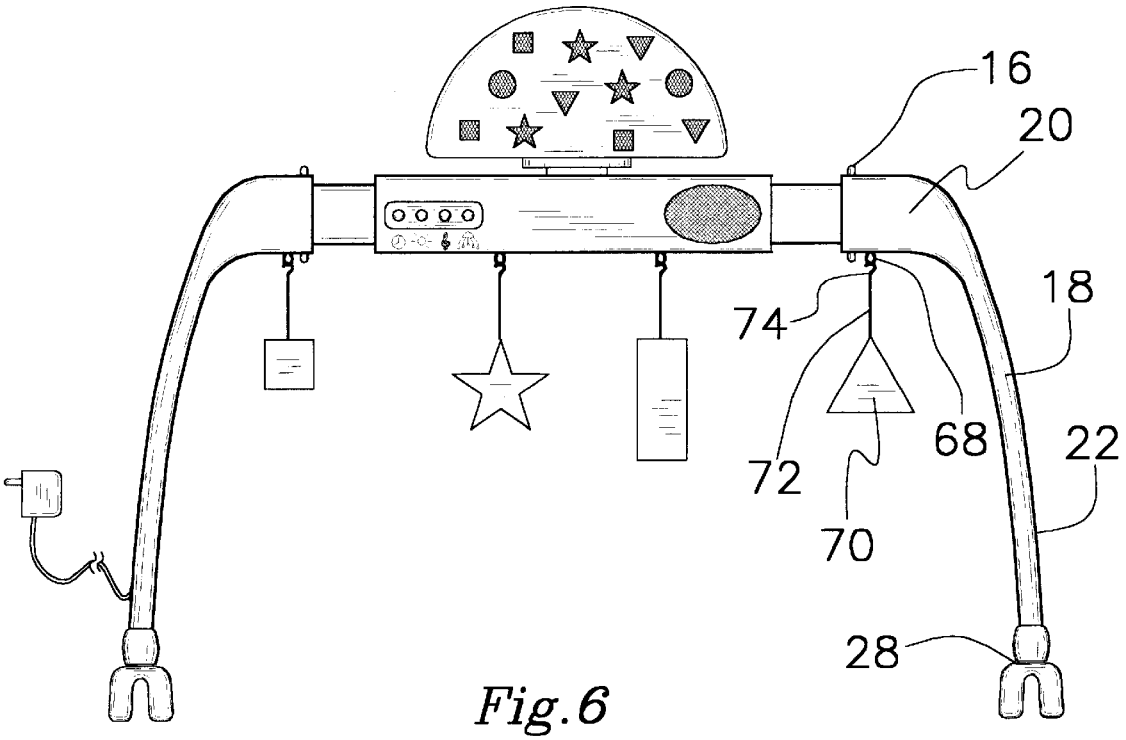
FIG. 6 is a front view of the frame of the present invention with the figurines attached in lieu of the mobile.

As shown in FIG. 6, a plurality of eyelets 68 are mounted along the bottom face of the horizontal cross bar of the frame and a bottom of the horizontal portion of each of the legs. Associated therewith is a plurality of figurines 70 each having a string 72 coupled thereto with a hook 74 for removably attaching to the eyelets of the frame. As such, when the present invention is used on a flat area such a ground surface, the mobile may be replaced with the removable figurines for interactive entertainment purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A child play station system comprising:

a frame including a cross bar and a pair of legs each being bifurcated into a pair of vertical portions which each terminate in a foot which defines a first slot adapted for receiving a rail of a crib; and at least one toy coupled to the frame;

wherein the frame is adapted for being supported by the legs on a flat recipient surface; and wherein each foot defines a second slot, the second slot orthogonally intersecting the first slot, the first slot having a unique width in relation to the second slot such that the first slot and the second slot are adapted for receiving the rail of a crib having varying widths.

2. The child play station system as set forth in claim 1 wherein a rotatable mobile and a plurality of individual figurines are each removably mounted to the frame.

3. The child play station system as set forth in claim 2 wherein the mobile is adapted to rotate automatically upon the actuation thereof.

4. The child play station system as set forth in claim 1 wherein the frame includes a monitoring unit for transmitting sounds to a portable module.

5. The child play station system as set forth in claim 1 wherein the frame includes a rotatable light assembly mounted thereon for rotating and emitting light upon the actuation thereof.

6. The child play station system as set forth in claim 1 wherein the frame includes a music mechanism adapted to emit soft quiet music upon the actuation thereof.

7. The child play station system as set forth in claim 1 wherein the legs are slidably coupled to the frame for being selectively distanced with respect to each other.

8. The child play station system as set forth in claim 1 wherein a brace is mounted between the vertical portions of each of the legs.

9. The child play station system as set forth in claim 8 wherein at least one toy comprises a plurality of toys, wherein at least one of the plurality of toys is positioned on the brace.

10. The child play station system as set forth in claim 1 wherein the system is battery powered.

11. The child play station system as set forth in claim 1 wherein the system is powered by an alternating power receptacle.

12. A child play station system comprising, in combination:

a frame including a horizontal cross bar with a square cross-section along a length thereof thus defining a top face, a bottom face, a pair of side faces, and a pair of ends each with a pair of spring biased tabs mounted on the top face and the bottom face thereof, the frame further including a pair of legs each having a hollow short upper horizontal portion with a plurality of apertures formed therein for slidably receiving one of the ends of the horizontal cross bar and being selectively fixed with respect thereto by the engagement of the spring biased tabs and the apertures, each of the legs being bifurcated into a pair of diverging vertical portions which reside in a plane which is perpendicular with the horizontal cross bar and having a horizontal brace mounted between intermediate extents of the vertical portions of the leg, each vertical portion of the legs terminating with a foot having a vertically oriented threaded post threadedly engaged within a threaded aperture formed in the vertical portion, four downwardly extending blocks defining a pair of intersecting slots each having a unique width, wherein the feet of the frame are adapted for being removably mounted on any one of a plurality of cribs having unique widths and rails of unique thickness;

a light assembly including an opaque elliptical dome mounted on a central extent of the top face of the horizontal cross bar of the frame with a plurality of cut outs formed therein, a motor connected between the frame and the dome for rotating the same about a vertical axis upon the actuation of the light assembly, and a light positioned with the dome for emitting light from the cut outs upon the actuation of the light assembly;

a music mechanism mounted within the horizontal cross bar of the frame and adapted to emit soft quiet music upon the actuation thereof;

a monitoring unit positioned within the horizontal cross bar of the frame and including a microphone mounted on one of the side faces of the horizontal cross bar of the frame for detecting audible signals upon the receipt thereof and a transmitter connected to the microphone for transmitting the audible signals via free space;

a timer positioned within the horizontal cross bar of the frame and adapted to track a predetermined amount of time;

a mobile including a disk removably attached to a central extent of the bottom face of the horizontal cross bar of the frame, a plurality of flexible resilient arcuate members coupled to a periphery of the disk and each extending outwardly and downwardly therefrom with a figurine mounted on an end thereof, and a motor connected between the frame and the disk for rotating the same upon the actuation thereof;

a control panel situated on one of the side faces of the horizontal cross bar of the frame and including a music button for actuating the music mechanism upon the depression thereof, a light button for actuating the light assembly upon the depression thereof, a mobile button for actuating the mobile upon the depression thereof, and a timer button for deactuating each of the music mechanism, light assembly and mobile upon the cessation of the predetermined amount of time upon the depression thereof;

a portable module including a speaker for transmitting audible signals therefrom upon the receipt thereof, a receiver connected to the speaker for transmitting audible signals thereto upon the receipt thereof via free space from the transmitter of the monitoring unit, a music button for actuating the music mechanism upon the depression thereof, a light button for actuating the light assembly upon the depression thereof, a mobile button for actuating the mobile upon the depression thereof, and a timer button for deactuating each of the music mechanism, light assembly and mobile upon the cessation of the predetermined amount of time upon the depression thereof, wherein the portable module further includes a power switch, a volume selector and a band selector;

a plurality of eyelets mounted along the bottom face of the horizontal cross bar of the frame and a bottom of the horizontal portion of each of the legs; and a plurality of figurines each having a string coupled thereto with a hook for removably attaching to the eyelets of the frame.

* * * * *